United States Patent [19]

Mayer

[11] Patent Number: 4,592,330

[45] Date of Patent: Jun. 3, 1986

[54] PRESSURE WAVE SUPERCHARGER WITH AN EXHAUST GAS BLOW-DOWN VALVE

[75] Inventor: Andreas Mayer, Niederrohrdorf, Switzerland

[73] Assignee: BBC Brown, Boveri & Company, Limited, Baden, Switzerland

[21] Appl. No.: 623,239

[22] Filed: Jun. 21, 1984

[30] Foreign Application Priority Data

Jun. 29, 1983 [CH] Switzerland ..... 3561/83

[51] Int. Cl.[4] ..... F02B 33/42

[52] U.S. Cl. ..... 123/559; 60/602

[58] Field of Search ..... 60/39.45, 602; 123/559; 417/64

[56] References Cited

U.S. PATENT DOCUMENTS

| | | | |
|---|---|---|---|
| 2,800,120 | 7/1957 | Jendrassik | 123/559 |
| 2,836,346 | 5/1958 | Jendrassik | 123/559 X |
| 3,190,542 | 6/1965 | Vickery | 417/64 |
| 4,120,156 | 10/1978 | McInerney | 60/602 |

FOREIGN PATENT DOCUMENTS

| | | | |
|---|---|---|---|
| 0123990 | 7/1984 | European Pat. Off. . | |
| 351141 | 2/1961 | Switzerland | 417/64 |

OTHER PUBLICATIONS

*Theoretical Hydrodynamics*, L. M. Milne-Thomson, The MacMillan Company, 4th Edition (1960), pp. 6 and 7.

*Primary Examiner*—Michael Koczo

*Attorney, Agent, or Firm*—Burns, Doane, Swecker & Mathis

[57] ABSTRACT

An exhaust gas blow-down valve of a pressure wave supercharger comprising a flap which is connected by a flap lever, a flap shaft and a second lever to a control device responsive to a process pressure of the pressure wave supercharger. In order to avoid deterioration of the scavenging coefficient of the pressure wave supercharger, a restraining screen is provided around part of the periphery of the flap at a distance from it, which restraining screen deflects the exhaust gas flowing out of the flap gap into the desired direction parallel to the axis of the exhaust gas outlet stub pipe.

3 Claims, 5 Drawing Figures

CONTROL DEVICE

IV
16
17
14
15
1
11
18
9
8
13
10
12
19
5
3
4
IV

PRESSURE WAVE SUPERCHARGER WITH AN EXHAUST GAS BLOW-DOWN VALVE

FIELD OF THE INVENTION

The present invention concerns a pressure wave supercharger with an exhaust gas blow-down valve.

BACKGROUND OF THE INVENTION

In automobile engines with pressure wave superchargers, the peak pressures in the cylinders should be in the vicinity of the allowable maximum combustion pressure over a wide rotational speed range. In order to attain this desired condition, a pressure wave supercharger for such engines is so designed that it generates a supercharge pressure under load at the maximum engine rotational speed which, without blow-down of the exhaust gas, is higher than the supercharge pressure necessary to generate the allowable peak pressure. By means of exhaust gas blow-down, which is controlled for example by the supercharge pressure, a higher allowable supercharge pressure and, therefore, more favorable variations of torque and fuel consumption can be attained over a wide operating range. A vehicle equipped with such an engine can therefore be driven without much gear changing.

Blow-down of exhaust gas does not have to be employed in the case of utility vehicle engines because they permit higher supercharge pressures and operate over a narrower rotational speed range than passenger car engines. In the case of utility vehicles, therefore, it is sufficient so to design the pressure wave supercharger that it supplies the maximum supercharge pressure for which the peak value of the combustion pressure is still allowable over the desired operating range.

A control device for controlling supercharge pressure by means of appropriate blow-down of the engine exhaust gas before the pressure wave supercharger is known from the European patent application No. EP-Al 0 123, 990. The valve element used in the device there described, by which the blow-down duct (known to experts as the wastegate) is more of less freed or closed, is a spring loaded plate valve. In a further device, described in the Swiss Pat. No. 398,185, for controlling the supercharge pressure by blow-down of exhaust gas and in which the exhaust gas pressure is used for actuating the valve element, the valve element is again spring loaded and is mushroom-shaped in the region of the sealing elements.

The springs of such plate and mushroom valves are heavily thermally loaded by the exhaust gases passing by the valve, which loading alters their spring constants in the course of time so that the valve opens earlier. The blow-down pressure in the supercharger and hence also the combustion pressures are reduced. The result, therefore, is loss of power in the operating range of the engine mentioned at the beginning.

In order to avoid these disadvantages of the two blow-down devices previously mentioned, use has been made—instead of the spring loaded plate and mushroom valve mentioned—of a flap valve which does not require a spring in the blow-down range and is actuated by exhaust gas pressure or, as described in the Swiss patent application No. 2355/83-7 mentioned, by another suitable process pressure. The actuation force then acts on a lever rotationally stiffly connected to the flap valve. Such a flap valve is substantially cheaper to produce than the two known types of valves mentioned above. In addition, no change to the opening characteristic occurs with such a flap valve because the spring is no longer required. However, with the aforementioned plate and mushroom valves the excess exhaust gases flow symmetrically about the valve's longitudinal axis and substantially parallel to the flow of the low pressure exhaust gases, i.e. of the exhaust pipe gases in the exhaust gas outlet stub pipe. In contrast, the blow-down exhaust gases in a flap valve unfortunately flow into the exhaust gas outlet stub pipe with a velocity component transverse to the flow direction of the outlet pipe gases, which produces the disadvantages described below.

For satisfactory and effective functioning of the pressure wave supercharger, the expanded exhaust gases, after they have carried out their compression work, must be completely scavenged into the exhaust gas outlet stub pipe together with the mixture of air and exhaust gas, which has formed in the mixing zone, i.e. in the region of the separating surface between the air and exhaust gas. This scavenging is supported by the induction air, which enters the rotor cells on the side opposite to the exhaust openings, the rotor being simultaneously cooled by it. In order to obtain satisfactory compression efficiencies, however, even more thorough cooling of the rotor is necessary. For this purpose, the pressure wave supercharger must induce more air than the quantity of compressed supercharge air supplied to the engine. This additionally induced air is called scavenge air and the ratio of the scavenge air flow to the supercharge air flow is known as the "scavenging coefficient" of the pressure wave supercharger. This scavenging coefficient decreases with increasing engine rotational speed and decreasing engine load.

In a pressure wave supercharger, blow-down through the wastegate results mainly, as in a turbocharger, in a deterioration of the overall efficiency and hence the specific fuel consumption but not in the scavenging coeffficient because the scavenging energy decreases approximately in proportion to the compression energy.

In the case of small blow-down flows, the transverse component of the flow into the exhaust duct has no important adverse effect on the exhaust gas flow and, therefore, on the scavenging coefficient. In the case of larger blow-down flows, however, the scavenging deteriorates noticeably because of the large transverse component of the entry velocity and hence the compression efficiency is also adversely effected.

OBJECT AND SUMMARY OF THE INVENTION

The objective of the present invention is to avoid these disadvantages of the flap valve, which is intrinsically superior to the known types of valves with respect to cheaper manufacture and simpler construction.

This objective is attained, in accordance with the invention, by a pressure wave supercharger having an exhaust gas outlet stub poipe, an exhaust gas blow-down valve in the form of a flap valve and a restraining screen provided in the exhaust gas outlet stub pipe, which screen at least partially surrounds the periphery of the flap of the flap valve and extends substantially parallel to the axis of the exhaust gas outlet stub pipe.

BRIEF DESCRIPTION OF THE DRAWING

The preferred embodiments of the present invention are described in more detail below with reference to the drawing, wherein.

DETAILED DESCRIPTION OF THE PREFERRED EMBODIMENTS

Figure 1:
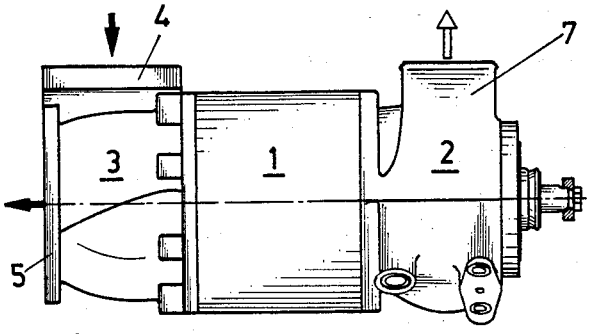
FIG. 1 is a side view of a pressure wave supercharger with an exhaust gas blow-down valve constructed in accordance with a first preferred embodiment of the present invention.

In FIG. 1, 1 indicates a rotor casing, 2 an air casing and 3 a gas casing of a pressure wave supercharger. On the top of the gas casing 3 is an exhaust gas inlet stub pipe 4, through which the exhaust gas coming from the engine and symbolized by the black vertical arrow enters under pressure. After it has carried out the compression work in the rotor, it emerges through the exhaust gas outlet stub pipe 5 parallel to the rotor axis into an exhaust installation, which is not shown, and is indicated by a black horizontal arrow. As may be seen from FIG. 2, the air casing 2 has a horizontal air inlet stub pipe 6, through which atmospheric pressure air is induced, and a vertical compressed air outlet stub pipe 7, see FIG. 1, through which the supercharged air compressed in the rotor cells emerges and whence it is let to the inlet side of the engine through a supercharge air pipe, which is not shown. Air inlet and outlet are shown by the white arrows in the two figures. The inlet can only be shown in FIG. 2 because the air inlet stub pipe is not visible in FIG. 1. The exhaust gas blow-down valve 8 located in the gas casing 3 is shown in a very simplified manner in FIG. 2.

Figure 3:
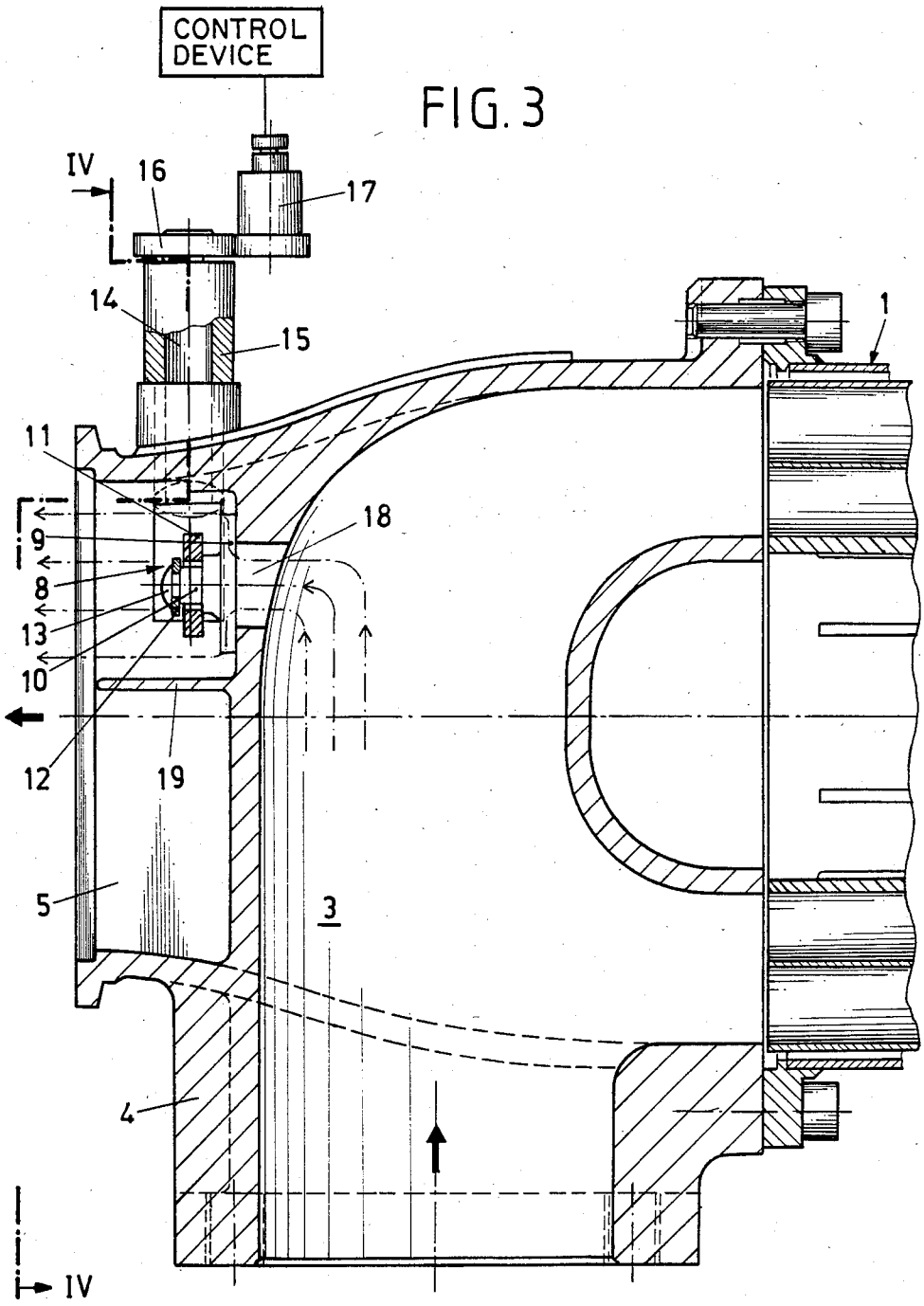
FIG. 3 is a partial, longitudinal sectional view of the pressure wave supercharger of FIG. 1.
Figure 4:
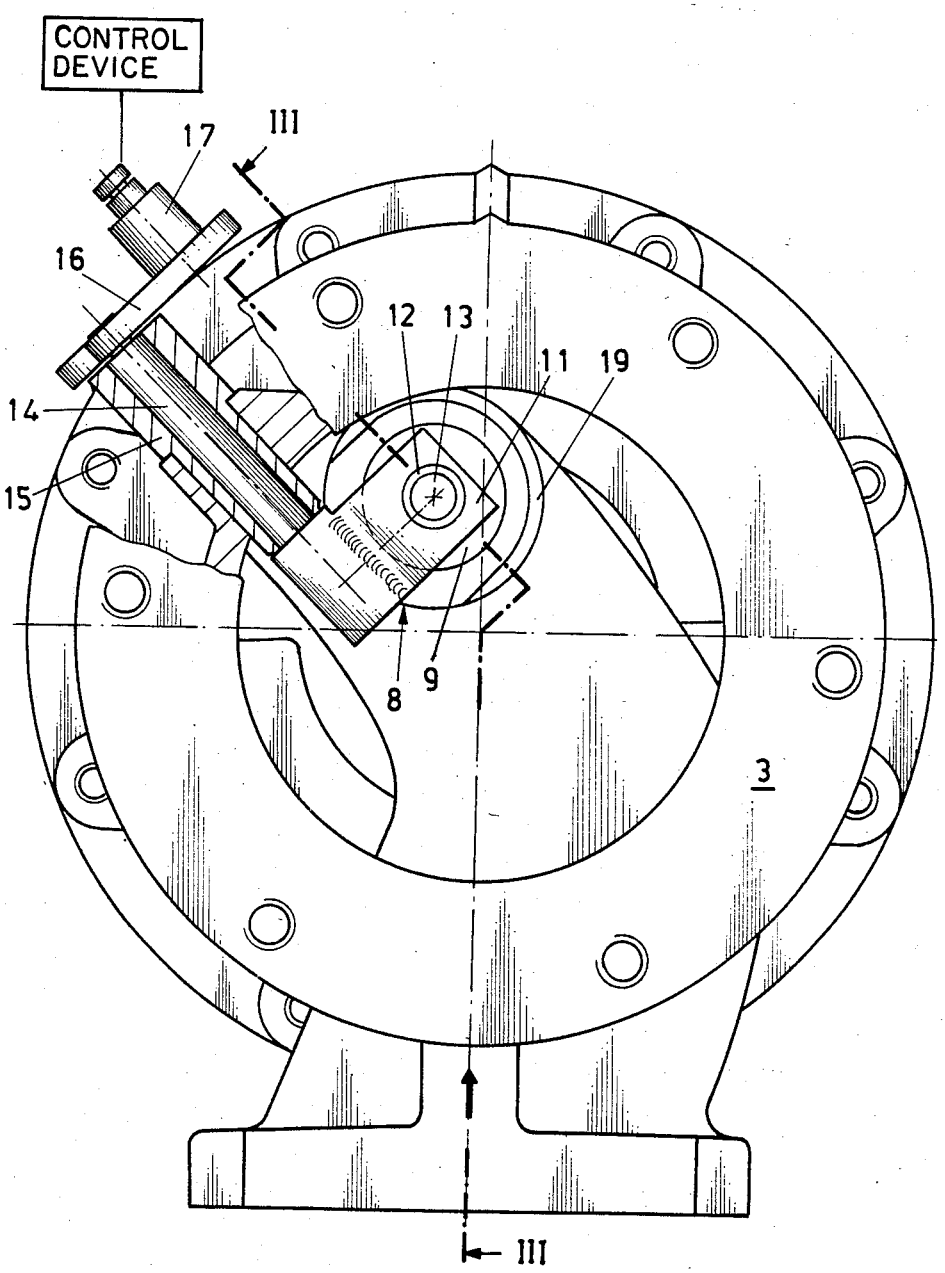
FIG. 4 is a partially sectional side view associated with FIG. 3.

FIGS. 3 and 4 show the gas casing 3 with the exhaust gas blow-down valve 8 in a longitudinal section and in a side view. The blow-down valve 8 has a flap 9 as the closing element. The latter is provided with a riveted seating 10, which sits with axial and radial clearance in a bore of a plate-shaped flap lever 11 and is retained in it by means of a washer 12 and a rivet head 13. The flap level 11 is solidly connected to the lower end of a flap shaft 14, for example by welding. This flap shaft is guided in a bearing bush 15 and extends obliquely upwards through the gas casing 3 to the outside where it is rotationally rigidly connected to an external lever 16. At its free end, the latter carries a pin 17 for connection to a rod, which is not shown, and which connects the flap 9 to a control device of the type mentioned at the beginning of this disclosure.

In order to now avoid the transverse component, mentioned at the beginning, of the blow-down flow which enters through the blow-down duct 18 into the exhaust installation continuing from the exhaust gas outlet stub pipe 5—or at least to decrease it decisively—a restraining screen 19 is provided at a distance around the flap 9. By means of this screen, the stream filaments, which adversely affect the undisturbed exhaust flow in the exhaust duct and hence the scavenging mentioned at the beginning—when using a cheap flap instead of an expensive but axi-symmetrical flow plate or mushroom valve—are forced, immediately after flowing through the annular gap freed by the flap, into a direction parallel to the axis of the exhaust gas outlet stub pipe 5, as is indicated by the chain-dotted streamlines in FIG. 3. The chain-dotted representation of the streamlines has been selected because the flap 9 is shown in the closed condition. They are, therefore, the streamlines which would occur if the flap were open.

This restraining screen 19 does not enclose the complete periphery of the flap 9; part of it encloses half the periphery as a semi-circular ring coaxial with the flap 9. Each of the two ends of this semi-circular ring subsequently run out there to a point whose inner boundaries, viewed radially inwards, run parallel to the longitudinal edges of the flap lever 11. The region of the restraining screen recessed out in this manner for the flap lever 11 does not deteriorate the directional effect because the narrowest point of the flap gap occurs there and the flow is also forced into the direction parallel to the axis by the neighbouring wall part of the exhaust gas outlet stub pipe 5.

Figure 5:
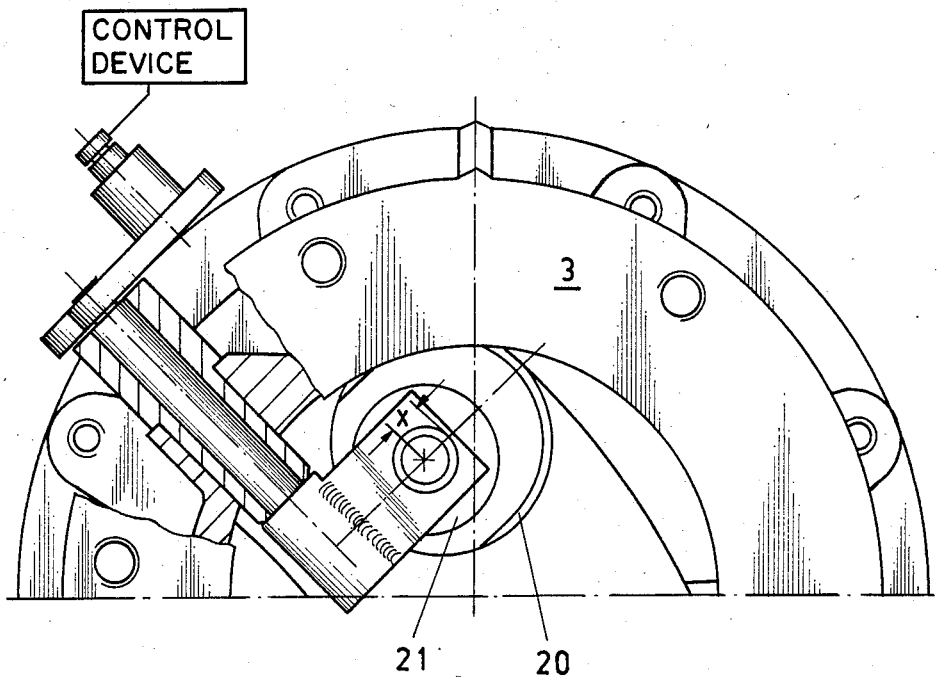
FIG. 5 is a partially sectional side view of a pressure wave supercharger having a second embodiment form of an exhaust gas blow-down valve.

In the embodiment in accordance with FIG. 5, the axis of the restraining screen 20 is eccentric by the distance x to the axis of the associated flap 21. By this means a larger outlet flow cross-section after the flap gap is obtained.

Figure 2:
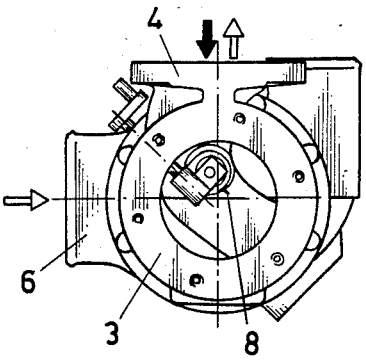
FIG. 2 is an end view of the supercharger of FIG. 1.

It remains to be stated that in the embodiment of the gas casing in accordance with FIGS. 3 to 5, the exhaust gas entry stub pipe 4 is not located on the top, as in the pressure wave supercharger in accordance with FIGS. 1 and 2, but on the bottom.

It is also possible to design the restraining screen as a complete circular ring which, therefore, encloses the complete periphery of the flap at a distance, either coaxially or eccentrically. The flap lever must then be of an approximately offset design.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. In a pressue wave supercharger with an exhaust blow-down valve, which pressure wave supercharger has a rotor casing, a cell rotor in which exhaust gas of an internal combustion engine is utilized to compress combustion air required by an internal combustion engine, an air casing through which the atmospheric air is induced and, after compression in the cell rotor, is supplied as supercharged air to the internal combustion engine, and a gas casing defining an exhaust gas space, by which the exhaust gas coming from the internal combustion engine is led into the cell rotor and, after its expansion in the cell rotor, is led into an exhaust gas outlet stub pipe, which pipe leads into an exhaust gas collector, the exhaust gas blow-down valve being located in a wall of the gas casing separating the exhaust gas space from the exhaust gas outlet stub pipe and being a flap valve having a flap and levered shaft means for connecting said flap to a control device, wherein the improvement comprises a restraining screen in the exhaust gas outlet stub pipe, which restraining screen surrounds at least a part of the periphery of the flap at a distance from said periphery, the restraining screen having a wall extending substantially parallel to the axis of the exhaust gas outlet stub pipe and into the exhaust gas outlet stub pipe.

2. The pressure wave supercharger in accordance with claim 1, wherein said connecting means includes a shaft with a flap lever and an external lever affixed to said shaft and the flap includes a circular disc with a rivet seating connecting the flap with the flap lever, the wall of the restraining screen being coaxial with the flap.

3. The pressure wave supercharger in accordance with claim 1, wherein said connecting means includes a shaft with a flap lever and an external lever affixed to said shaft and the flap includes a circular disc with a rivet seating connecting the flap to the flap lever, the wall of the restraining screen being eccentric to an axis of the flap by a distance (x) such that a center region of the wall of the restraining screen is further removed from the periphery of the flap than the two ends of the wall of the restraining screen.

* * * * *